US009170565B2

(12) United States Patent
Kobayashi et al.

(10) Patent No.: US 9,170,565 B2
(45) Date of Patent: Oct. 27, 2015

(54) INTERIOR COMPONENT POSITIONING STRUCTURE, TIMEPIECE, AND INTERIOR COMPONENT POSITIONING METHOD

(71) Applicant: CASIO COMPUTER CO., LTD., Shibuya-ku, Tokyo (JP)

(72) Inventors: Kazuma Kobayashi, Fuchu (JP); Kazumasa Yokoo, Higashiyamato (JP); Junichi Sato, Hino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/080,744

(22) Filed: Nov. 14, 2013

(65) Prior Publication Data

US 2014/0169143 A1 Jun. 19, 2014

(30) Foreign Application Priority Data

Dec. 14, 2012 (JP) ..... 2012-272929

(51) Int. Cl.

| | |
|---|---|
| ***G04B 19/06*** | (2006.01) |
| ***G04B 29/00*** | (2006.01) |
| ***G04B 19/14*** | (2006.01) |
| ***G04B 37/00*** | (2006.01) |
| ***G04B 37/08*** | (2006.01) |
| ***G04B 37/04*** | (2006.01) |
| ***G04B 37/05*** | (2006.01) |
| ***G04G 17/02*** | (2006.01) |

(52) U.S. Cl.

CPC ..... *G04G 17/02* (2013.01); *G04B 37/00* (2013.01); *G04B 37/04* (2013.01); *G04B 37/05* (2013.01); *G04B 19/14* (2013.01); *G04B 37/08* (2013.01); *Y10T 29/49778* (2015.01)

(58) Field of Classification Search

CPC ..... G04B 37/00; G04B 37/04; G04B 37/05; G04B 37/08

USPC ..... 368/276, 297–300, 232, 236

See application file for complete search history.

(56) References Cited

U.S. PATENT DOCUMENTS

| | | | | |
|---|---|---|---|---|
| 4,493,562 | A * | 1/1985 | Gagnebin | 368/294 |
| 5,519,674 | A * | 5/1996 | Vollert et al. | 368/294 |
| 5,703,837 | A * | 12/1997 | Umemoto et al. | 368/88 |
| 5,943,302 | A * | 8/1999 | Fanshaw | 368/276 |
| 6,322,246 | B1 * | 11/2001 | Leung | 368/299 |

(Continued)

FOREIGN PATENT DOCUMENTS

JP 60-061687 U 4/1985

*Primary Examiner* — Amy Cohen Johnson
*Assistant Examiner* — Daniel Wicklund
(74) *Attorney, Agent, or Firm* — Holtz, Holtz, Goodman & Chick PC

(57) ABSTRACT

A structure includes a wristwatch case; an inner frame arranged inside the wristwatch case and having an upper surface provided with a positioning fitting recess; a timepiece module arranged as being positioned inside the inner frame; and a parting plate which is provided with a positioning pin that is provided on a lower surface of the parting plate facing the upper surface of the inner frame, and that is fitted into the positioning fitting recess of the inner frame, thereby positioning the parting plate with respect to respect to the inner frame. As a result, in a state where the timepiece module is arranged and positioned inside the inner frame arranged in the wristwatch case, the positioning pin of the parting plate can be fitted into the positioning fitting recess of the inner frame. Accordingly, the parting plate can be accurately positioned with respect to the inner frame.

9 Claims, 4 Drawing Sheets

(56) References Cited

U.S. PATENT DOCUMENTS

| | | | | |
|---|---|---|---|---|
| 8,398,300 | B2 * | 3/2013 | Chan | 368/280 |
| 8,659,979 | B2 * | 2/2014 | Tsuji et al. | 368/88 |
| 2002/0131332 | A1 * | 9/2002 | Kaelin et al. | 368/281 |
| 2006/0114753 | A1 * | 6/2006 | Gerber | 368/295 |
| 2008/0101165 | A1 * | 5/2008 | Cretin et al. | 368/297 |
| 2009/0073816 | A1 * | 3/2009 | Ozawa et al. | 368/294 |
| 2010/0142332 | A1 * | 6/2010 | Hiranuma et al. | 368/310 |
| 2011/0096481 | A1 * | 4/2011 | Ueno | 361/679.01 |
| 2012/0120779 | A1 * | 5/2012 | Altenhoven et al. | 368/300 |
| 2012/0257481 | A1 * | 10/2012 | Hiranuma | 368/205 |

* cited by examiner

INTERIOR COMPONENT POSITIONING STRUCTURE, TIMEPIECE, AND INTERIOR COMPONENT POSITIONING METHOD

CROSS-REFERENCE TO RELATED APPLICATION

This application is based upon and claims the benefit of priority from the prior Japanese Patent Application No. 2012-272929, filed Dec. 14, 2012, the entire contents of which are incorporated herein by reference.

BACKGROUND OF THE INVENTION

1. Field of the Invention

The present invention relates to an interior component positioning structure, timepiece, and interior component positioning method for use in an electronic device such as a wristwatch.

2. Description of the Related Art

For example, an inner component positioning structure for wristwatches is known as described in Japanese Utility-Model Application Laid-Open (Kokai) Publication No. 60-061687. In this structure, a flange-shaped projecting section is provided on an inner peripheral surface of a wristwatch case at the same position in height as a timepiece module such that the flange-shaped projecting section projects toward the inside of the wristwatch case, a parting plate is arranged and positioned on an upper side of this projecting section, an inner frame is arranged and positioned on a lower side of the flange-shaped projecting section, and a timepiece module is arranged and positioned inside the inner frame.

In this inner component positioning structure for wristwatches, to position the parting plate and the inner frame inside the wristwatch case, a positioning hole is provided such that the positioning hole vertically penetrates through the flange-shaped projecting section provided on the wristwatch case, and a positioning projection of the parting plate is inserted from above into this positioning hole and a positioning projection of the inner frame is inserted from below into this positioning hole. As a result, the parting plate and the inner frame can be positioned inside the wristwatch case.

However, in this inner component positioning structure for wristwatches, the positioning projection of the parting plate and the positioning projection of the inner frame are inserted into the same positioning hole provided on the projecting section of the wristwatch case, whereby the parting plate and the inner frame are positioned with respect to the wristwatch case. In other words, the positioning projection of the parting plate and the positioning projection of the inner frame are positioned through the positioning hole. As a result, it is disadvantageously difficult to increase positioning accuracy.

Moreover, since the flange-shaped projecting section is provided on the inner peripheral surface of the wristwatch case at the same position in height as the timepiece module such that the flange-shaped projecting section projects toward the inside of the wristwatch case, the outer diameter of the timepiece module is disadvantageously limited.

SUMMARY OF THE INVENTION

The present invention is to provide an interior component positioning structure, timepiece, and interior component positioning method capable of accurately positioning a parting member with respect to an inner frame and a module without limiting the outer diameter of the module.

In order to achieve the above-described object, in accordance with one aspect of the present invention, there is provided an interior component positioning structure comprising: a case; an inner frame which is arranged inside the case and an upper surface of which is provided with a positioning fitting recess; a module which is arranged as being positioned inside the inner frame; and a parting member which is provided with a positioning projection that is provided on a lower surface of the parting member facing the upper surface of the inner frame, and that is fitted into the positioning fitting recess of the inner frame, thereby positioning the parting member with respect to the inner frame, wherein the case is provided with a flange-shaped projecting section provided on an inner peripheral surface of the case at a position higher than an upper surface of the module and arranged between the inner frame and the parting member, and the flange-shaped projecting section is provided with an insertion hole from which the positioning projection of the parting member is inserted to project.

In order to achieve the above-described object, in accordance with one aspect of the present invention, there is provided a timepiece comprising a positioning structure, the positioning structure including: a case, an inner frame which is arranged inside the case and an upper surface of which is provided with a positioning fitting recess, a module which is arranged as being positioned inside the inner frame and a parting member which is provided with a positioning projection that is provided on a lower surface of the parting member facing the upper surface of the inner frame, and that is fitted into the positioning fitting recess of the inner frame, thereby positioning the parting member with respect to the inner frame, wherein the case is provided with a flange-shaped projecting section provided on an inner peripheral surface of the case at a position higher than an upper surface of the module and arranged between the inner frame and the parting member, and the flange-shaped projecting section is provided with an insertion hole from which the positioning projection of the parting member is inserted to project.

In order to achieve the above-described object, in accordance with one aspect of the present invention, there is provided an interior component positioning method comprising: a positioning step of positioning an inner frame and a module arranged inside a case; and a fitting step of causing a positioning projection provided on a lower surface of a parting member to penetrate through an insertion hole of a flange-shaped projecting section provided on an inner peripheral surface of the case at a position higher than an upper surface of the module and arranged between the inner frame and the parting member, and to be fitted into a positioning fitting recess provided on an upper surface of the inner frame.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

With reference to FIG. 1 to FIG. 4, an embodiment will be described below in which the present invention has been applied to a pointer-type wristwatch.

Figure 1:
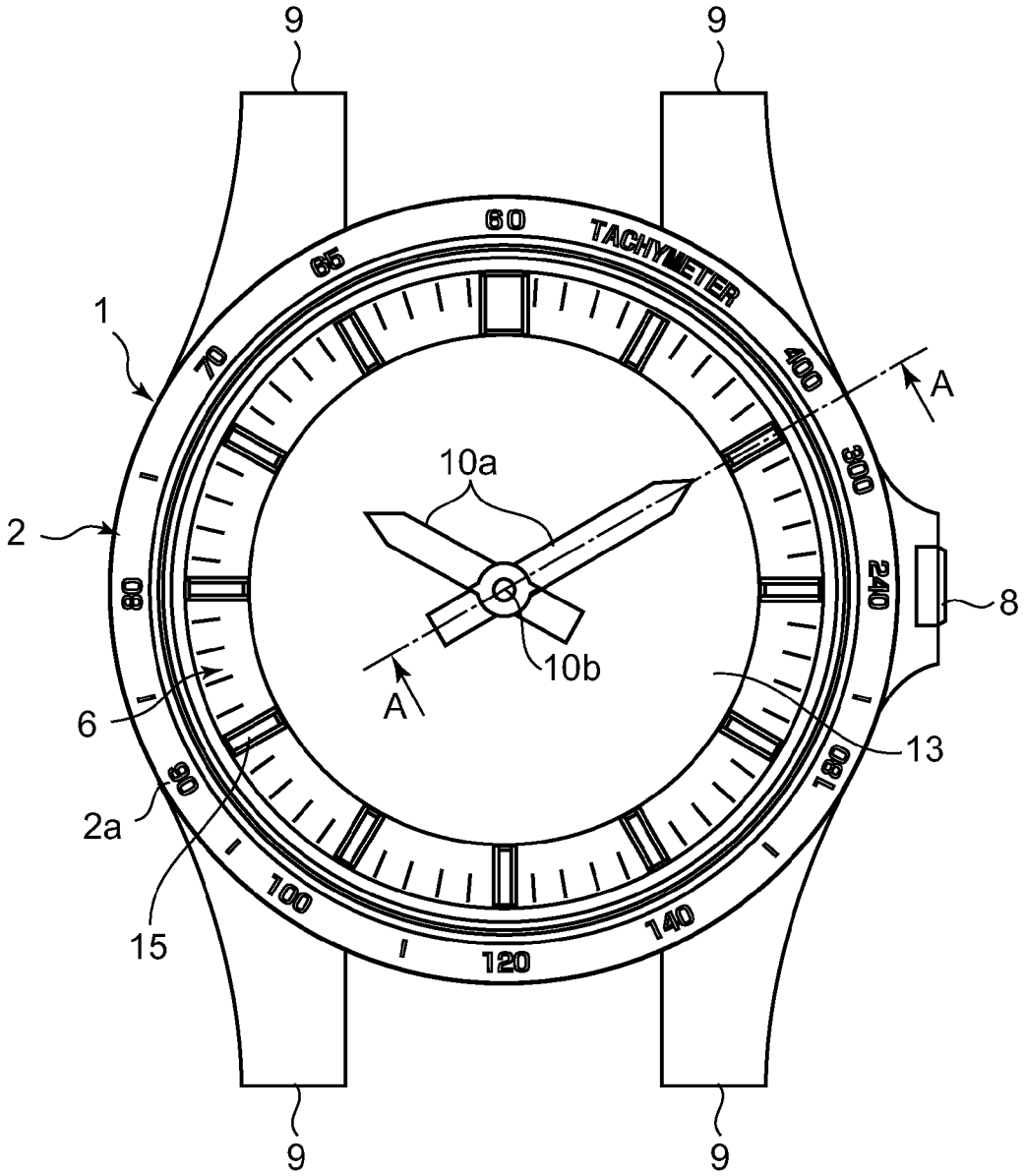
FIG. 1 is an enlarged front view of an embodiment in which the present invention is applied to a pointer-type wristwatch.
Figure 2:
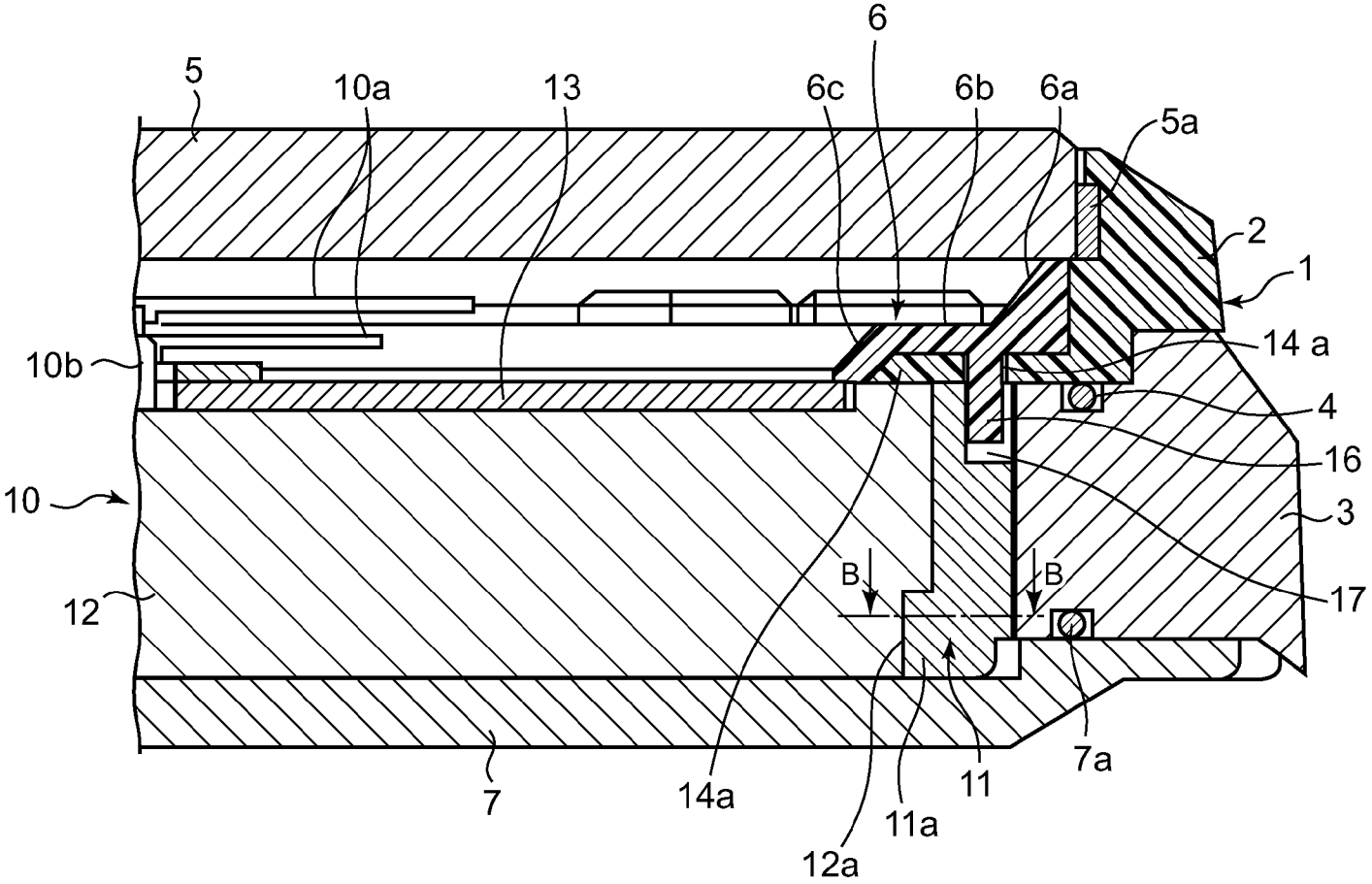
FIG. 2 is an enlarged sectional view of main sections of the wristwatch depicted in FIG. 1, taken along an A-A arrow.

The wristwatch includes a wristwatch case 1, as depicted in FIG. 1 and FIG. 2.

The wristwatch case 1 has an upper case 2 and a lower case 3, and is structured such that the upper case 2 and the lower case 3 are vertically jointed together via a waterproof gasket 4.

Figure 3:
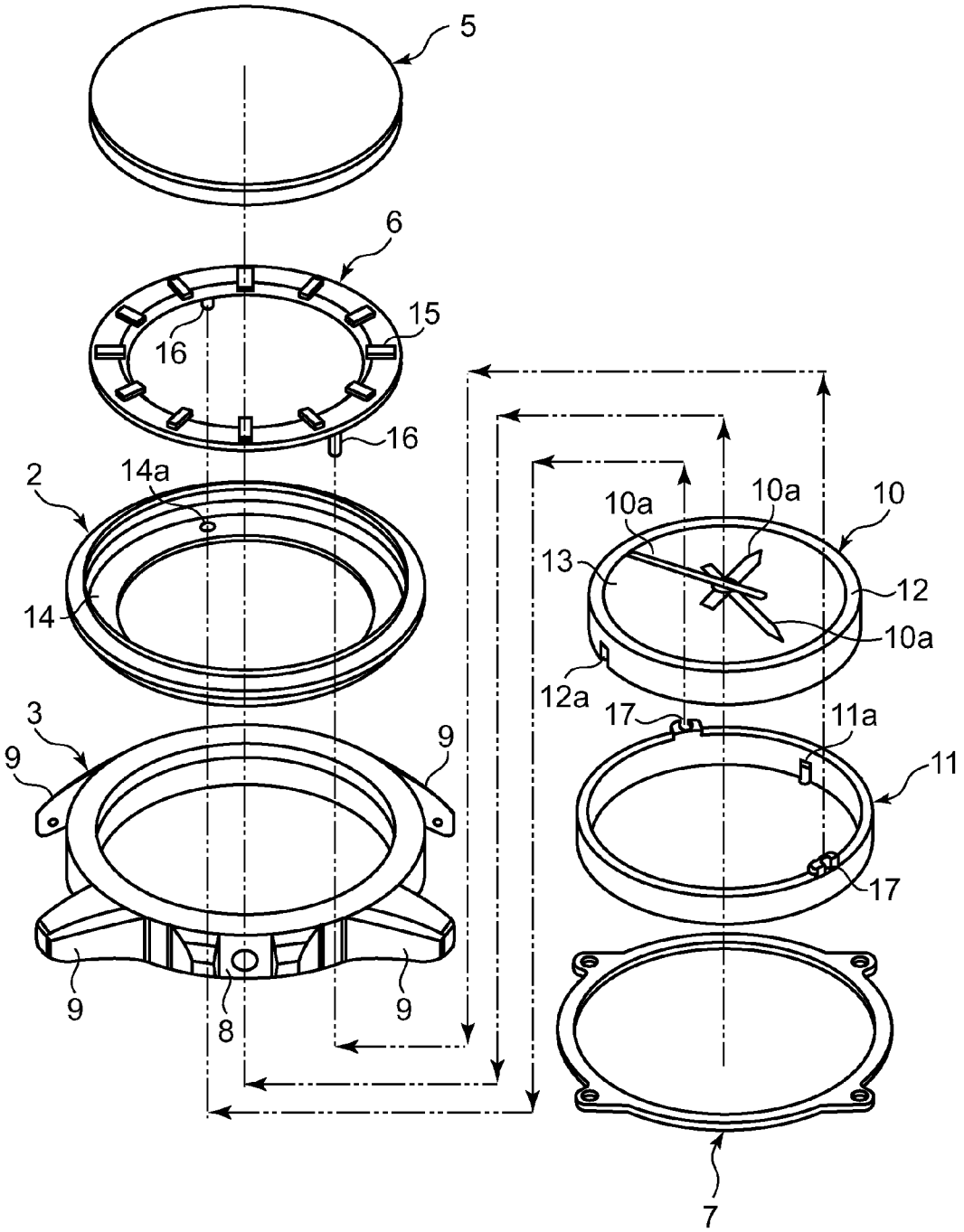
FIG. 3 is an enlarged perspective view of the wristwatch depicted in FIG. 2.

A timepiece glass 5 is mounted via a gasket 5*a* on an upper opening of the wristwatch case 1, that is, on an upper opening of the upper case 2, as depicted in FIG. 1 to FIG. 3.

A parting plate 6 is arranged on a lower surface of the timepiece glass 5 in the upper case 2 of the wristwatch case 1.

Also, a back cover 7 (case back) is mounted via a waterproof ring 7*a* on a lower portion of the lower case 3 of the wristwatch case 1.

Furthermore, a push-button switch 8 is provided on a side portion positioned on the three o'clock side of the wristwatch case 1, as depicted in FIG. 1 and FIG. 3.

A band mount section 9 is provided on each of side portions positioned on the twelve o'clock side and the six o'clock side of the wristwatch case 1.

A timepiece module 10 is provided via an inner frame 11 inside the wristwatch case 1, that is, inside the lower case 3, as depicted in FIG. 2 and FIG. 3.

The timepiece module 10 includes a housing 12 made of synthetic resin.

A dial plate 13 is arranged on an upper surface of the housing 12, as depicted in FIG. 2 and FIG. 3.

Also, various components (any of which are not depicted in the drawings) required for timepiece functions, such as a timepiece movement indicating the time by moving pointers 10*a*, are incorporated in the housing 12.

In this case, the timepiece movement has a pointer shaft 10*b* projecting upward through a through hole 13*a* of the dial plate 13.

The timepiece movement is structured such that the pointers 10*a* move in a state where the pointers 10*a* are mounted on an upper portion of the projecting pointer shaft 10*b*.

The inner frame 11 is formed in a cylindrical shape as a whole, as depicted in FIG. 2 and FIG. 3, and is structured to be arranged inside the lower case 3 along its inner peripheral surface.

Inside the inner frame 11, the timepiece module 10 is arranged and positioned.

Figure 4:
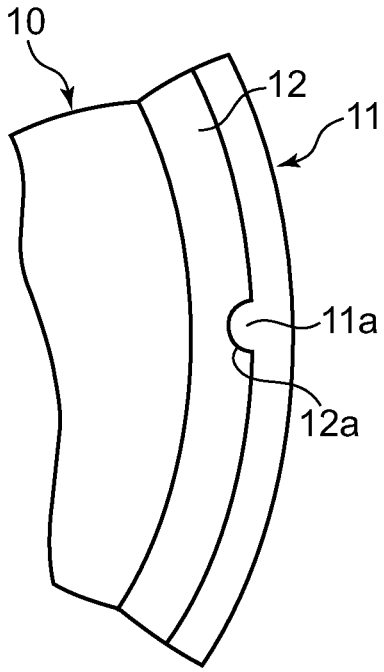
FIG. 4 is an enlarged sectional view of main sections of the wristwatch depicted in FIG. 2, taken along a B-B arrow.

That is, positioning projections 11*a* are provided at radially opposite positions in the inner peripheral surface of the inner frame 11 such that the positioning projections 11*a* project toward the inside of the inner frame 11, as depicted in FIG. 2 to FIG. 4.

Each of the positioning projections 11*a* is formed in a semi-cylindrical shape and provided on a lower portion of the inner peripheral surface of the inner frame 11 along the vertical direction, as depicted in FIG. 2 to FIG. 4.

Also, positioning recesses 12*a* are provided at radially opposite positions in an outer peripheral surface of the timepiece module 10, that is, an outer peripheral surface of the housing 12. The positioning projections 11*a* of the inner frame 11 are respectively fitted into the positioning recesses 12*a*.

The positioning recesses 12*a* are semi-cylindrical grooves and provided on a lower portion of the outer peripheral surface of the housing 12 along the vertical direction, as depicted in FIG. 2 and FIG. 4.

As a result, regarding the timepiece module 10 and the inner frame 11, when the timepiece module 10 is inserted from above into the inside of the inner frame 11, the positioning projections 11*a* of the inner frame 11 are fitted into the positioning recesses 12*a* provided on the housing 12 of the timepiece module 10.

Accordingly, the timepiece module 10 is structured to be positioned inside the inner frame 11.

That is, regarding the timepiece module 10 and the inner frame 11, the positioning projections 11*a* of the inner frame 11 are inserted from below and fitted into the positioning recesses 12*a* of the housing 12, as depicted in FIG. 2 to FIG. 4.

Accordingly, the position of the housing 12 in a rotation direction with respect to the inner frame 11 is restricted, and the position of the housing 12 in the vertical direction with respect to the inner frame 11 is also restricted.

Meanwhile, the parting plate 6 is structured to be arranged above a flange-shaped projecting section 14 inside the upper case 2 of the wristwatch case 1, in a state where the parting plate 6 is positioned on a lower side of the timepiece glass 5.

In this case, the upper case 2 is formed such that the thickness of the uppercase 2 in a diameter direction is thinner than the thickness of the lower case 3 in a diameter direction and that the inner diameter of the upper case 2 is larger than the inner diameter of the lower case 3.

As a result, the flange-shaped projecting section 14 is provided on a lower portion on an inner peripheral surface of the upper case 2, such that the flange-shaped projecting section 14 projects from an upper surface of the lower case 3 via an upper surface of the inner frame 11 over an upper surface of the housing 12 of the timepiece module 10, as depicted in FIG. 2.

The waterproof gasket 4 is arranged between a lower surface positioned near a boundary between the upper case 2 and the flange-shaped projecting section 14, and the upper surface of the lower case 3.

The parting plate 6 is made of metal such as stainless-steel, and is formed in a ring shape as a whole, as depicted in FIG. 2 and FIG. 3.

That is, the parting plate 6 includes a first tilted section 6*a* positioned on an outer peripheral side on the upper surface of the flange-shaped projecting section 14, a flat section 6*b* positioned on an inner peripheral side on the upper surface of the flange-shaped projecting section 14, and a second tilted section 6*c* arranged in a state where the second tilted section 6*c* is tilted from the upper surface of the flange-shaped projecting section 14 toward an upper surface of the dial plate 13 of the timepiece module 10.

In this case, the first tilted section 6*a* is arranged such that the lower surface of the first tilted section 6*a* is placed on the upper surface of the flange-shaped projecting section 14 in a state where the upper end thereof abuts on a lower surface of the timepiece glass 5, and the outer peripheral surface thereof abuts along the inner peripheral surface of the upper case 2.

The flat section 6*b* is arranged from an inner peripheral end of the first tilted section 6*a* along the upper surface of the flange-shaped projecting section 14.

The second tilted section 6*c* is arranged in a state where the second tilted section 6*c* is tilted from the inner peripheral end of the flat section 6*b* toward the upper surface of the dial plate 13.

As a result, the parting plate 6 is structured to press the timepiece module 10 from above by that the lower end portion positioned on the inner peripheral side of the second tilted section 6*c* abuts on the upper surface of the dial plate 13 in a state where the first tilted section 6*a* and the flat section 6*b* are arranged on the flange-shaped projecting section 14 of the upper case 2, as depicted in FIG. 2.

On the parting plate 6, a scale 15 such as an hour scale or a minute scale of time is displayed from an upper surface of the flat section 6*b* over an upper surface of the second tilted section 6*c*, as depicted in FIG. 1 and FIG. 3.

In this case, on an upper surface of the wristwatch case 1, that is, on an upper surface of the upper case 2, a scale 2*a* as an accessory function such as a tachy meter is displayed in a manner to correspond to the scale 15 of the parting plate 6, as depicted in FIG. 1.

Furthermore, the parting plate 6 is structured to be positioned with respect to the inner frame 11, as depicted in FIG. 2 and FIG. 3.

That is, a positioning pin 16 is provided to droop downward at each of two positions which are radially opposite on a lower surface of the flat section 6*b* of the parting plate 6.

The positioning pins 16 are made of metal such as stainless-steel, and are fixed to the flat section 6*b* of the parting plate 6 by welding such as spot welding.

On the other hand, the flange-shaped projecting section 14 of the timepiece case 1 is provided with vertically-penetrating insertion holes 14*a* where the positioning pins 16 of the parting plate 6 are inserted to project, as depicted in FIG. 2 and FIG. 3.

On the upper surface of the inner frame 11, positioning fitting recesses 17 are provided into which the positioning pins 16 of the parting plate 6 are inserted and fitted.

In this case, each of the positioning pins 16 of the parting plate 6 is formed such that its length in a vertical direction is sufficiently longer than the thickness of the flange-shaped projecting section 14 in a vertical direction, as depicted in FIG. 2.

Each of the insertion holes 14*a* of the flange-shaped projecting section 14 is formed such that its inner diameter is approximately equal to the outer diameter of each of the positioning pins 16 of the parting plate 6.

Also, each of the insertion holes 14*a* is provided to the flange-shaped projecting section 14 at a position corresponding to each of the positioning pins 16 of the parting plate 6.

On the other hand, each of the positioning fitting recesses 17 is a hole portion approximately equal to the outer diameter of each of the positioning pins 16 of the parting plate 6, and is provided to the upper surface of the inner frame 11 at a position corresponding to each of the positioning pins 16 of the parting plate 6, as depicted in FIG. 2.

The positioning fitting recesses 17 are structured such that each of the positioning pins 16 is inserted and fitted into each of the positioning fitting recesses 17 to be positioned in a planar direction of the parting plate 6.

That is, regarding the parting plate 6 and the inner frame 11, the positioning pins 16 of the parting plate 6 are inserted and fitted into the positioning fitting recesses 17 of the frame 11 through the insertion holes 14*a* of the flange-shaped projecting section 14 of the wristwatch case 1.

As a result, the parting plate 6 is positioned with respect to the inner frame 11 and the wristwatch case 1, and is furthermore positioned with the timepiece module 10 positioned with respect to the inner frame 11.

Next, the assembly of this wristwatch will be described.

First, the upper case 2 and the lower case 3 are jointed together via the waterproof gasket 4 therebetween.

As a result, the wristwatch case 1 is formed.

Then, the timepiece module 10 is inserted with the inner frame 11 into the wristwatch case 1 from below, and also the parting plate 6 is inserted thereinto from above.

In this case, the timepiece module 10 is inserted into the inner frame 11 in advance.

At this time, in order that the timepiece module 10 is inserted into the inner frame 11 from above, the positioning recesses 12*a* provided on the outer circumference of the housing 12 of the timepiece module 10 correspond to the positioning projections 11*a* provided on the inner peripheral surface of the inner frame 11.

Then, in this state, the timepiece module 10 is inserted into the inner frame 11 from above, whereby the positioning projections 11*a* of the inner frame 11 are fitted into the positioning recesses 12*a* of the housing 12.

As a result, the timepiece module 10 is positioned with respect to the inner frame 11.

In other words, since the positioning projections 11*a* of the inner frame 11 are fitted into the positioning recesses 12*a* of the housing 12, the position of the housing 12 with respect to the inner frame 11 in the rotation direction is restricted.

Furthermore, the position of the housing 12 with respect to the inner frame 11 in a vertical direction is also restricted.

In this state, the inner frame 11 is inserted together with the timepiece module 10 from below into the wristwatch case 1.

At this time, the positioning fitting recesses 17 provided on the upper surface of the inner frame 11 correspond to the insertion holes 14*a* provided to the flange-shaped projecting section 14 of the upper case 2 of the wristwatch case 1.

Then, in this state, the inner frame 11 is inserted from below into the lower case 3 of the wristwatch case 1, whereby the upper surface of the inner frame 11 abuts on the lower surface of the flange-shaped projecting section 14 of the upper case 2.

Then, the parting plate 6 is inserted from above into the upper case 2 of the wristwatch case 1.

At this time, the positioning pins 16 provided to the lower surface of the parting plate 6 correspond to the insertion holes 14*a* of the flange-shaped projecting section 14 of the upper case 2. In this state, the parting plate 6 is inserted from above into the upper case 2.

Thus, the positioning pins 16 of the parting plate 6 are inserted through the insertion holes 14*a* of the flange-shaped projecting section 14 into the positioning fitting recesses 17 of the inner frame 11.

As a result, in a state where the first tilted section 6*a* of the parting plate 6 is arranged in close contact with and along the inner peripheral surface of the upper case 2, the flat section 6*b* of the parting plate 6 is arranged in a manner to abut on the flange-shaped projecting section 14 of the upper case 2.

Furthermore, the lower end of the second tilted section 6*c* of the parting plate 6 is arranged in a manner to abut on the upper surface of the dial plate 13 on the timepiece module 10.

As a result, the dial plate 13 is pressed from above by the lower end of the second tilted section 6*c* of the parting plate 6, whereby the timepiece module 10 is vertically fixed in the inner frame 11.

In this state, the lower ends of the positioning pins 16 of the parting plate 6 project downward through the insertion holes 14*a* of the flange-shaped projecting sections 14 of the upper case 2, and are thereby fitted into the positioning fitting recesses 17 of the inner frame 11.

As a result, the parting plate 6 is positioned with respect to the inner frame 11 and also with respect to the timepiece module 10 positioned to the inner frame 11.

Additionally, since the positioning pins 16 are inserted into the insertion holes 14*a* of the flange-shaped projecting section 14 of the upper case 2, the parting plate 6 and the inner frame 11 are positioned with respect to the wristwatch case 1.

As a result, a positioning deviation due to assembly tolerance is suppressed, whereby the scale 15 such as an hour scale and a minute scale displayed on the parting plate 6 and the scale 2*a* as the accessory function of the upper case 2 are accurately positioned.

Furthermore, the pointers 10*a* of the timepiece module 10 are accurately positioned with respect to the scale 15 of the parting plate 6 and the scale 2*a* of the upper case 2.

Thereafter, the timepiece glass 5 is mounted on the upper case 2 of the wristwatch case 1 via the gasket 5*a*.

Also, the back cover 7 is mounted on the lower portion of the lower case 3 of the wristwatch case 1 via the waterproof ring 7*a*.

Accordingly, the wristwatch is assembled.

As such, the above-described wristwatch includes the wristwatch case 1; the inner frame 11 arranged inside the wristwatch case 1 and having the upper surface provided with the positioning fitting recesses 17; the timepiece module 10 arranged as being positioned inside the inner frame 11; and the parting plate 6 which is provided with positioning pins 16 that are provided on a lower surface of the parting plate 6 facing the upper surface of the inner frame 11, and that are fitted into the positioning fitting recesses 17 of the inner frame 11, thereby positioning the parting plate 6 with respect to the inner frame 11.

Accordingly, the parting plate 6 can be accurately positioned with respect to the inner frame 11 and the timepiece module 10.

That is, according to the above-described wristwatch, in a state where the timepiece module 10 is arranged and positioned inside the inner frame 11 arranged inside the wristwatch case 1, the positioning pins 16 of the parting plate 6 can be fitted into the positioning fitting recesses 17 of the inner frame 11.

Accordingly, the parting plate 6 can be accurately positioned with respect to the inner frame 11 and also with respect to the timepiece module 10.

In this case, the flange-shaped projecting section 14 arranged between the inner frame 11 and the parting plate 6 is provided on the inner peripheral surface of the wristwatch case 1, and the flange-shaped projecting section 14 is provided with the insertion holes 14*a* into which the positioning pins 16 of the parting plate 6 are inserted.

As a result, when the positioning pins 16 of the parting plate 6 are fitted in the positioning fitting recesses 17 of the inner frame 11, the positioning pins 16 of the parting plate 6 can also be inserted into the insertion holes 14*a* of the flange-shaped projecting section 14. Accordingly, the parting plate 6 and the inner frame 11 can also be positioned with respect to the wristwatch case 1.

That is, since the positioning pins 16 of the parting plate 6 are inserted into the insertion holes 14*a* of the flange-shaped projecting section 14, the positioning pins 16 of the parting plate 6 are positioned with respect to the wristwatch case 1. Accordingly, the parting plate 6 can be positioned with respect to the wristwatch case 1.

Furthermore, by the positioning pins 16 of the parting plate 6, the inner frame 11 can also be positioned with respect to the wristwatch case 1.

Still further, since the positioning pins 16 of the parting plate 6 are inserted into the insertion holes 14*a* of the flange-shaped projecting section 14, the positioning pins 16 can be reliably and favorably protected by the flange-shaped projecting section 14.

Accordingly, the parting plate 6 can be reliably and favorably fixed onto the flange-shaped projecting section 14 of the wristwatch case 1.

As a result, even when receiving an impact due to falling, etc., the parting plate 6 and the inner frame 11 can be prevented from being deviated in position in the rotation direction with respect to the wristwatch case 1.

Yet still further, since the positioning pins 16 of the parting plate 6 are inserted into the insertion holes 14*a* of the flange-shaped projecting section 14, the parting plate 6 can be brought closer to the inner surface of the wristwatch case 1.

Yet still further, the positioning pins 16 of the parting plate 6 can be arranged outside the outer circumference of the timepiece module 10.

As a result, the timepiece module 10 is not restricted by the positioning pins 16. Accordingly, the display area in the entire wristwatch can be increased.

Additionally, in the above-described wristwatch, the positioning projections 11*a* are provided on the inner peripheral surface of the inner frame 11, and the positioning recesses 12*a* are provided on the outer peripheral surface of the housing 12 of the timepiece module 10.

As a result, when the timepiece module 10 is arranged inside the inner frame 11, the positioning projections 11*a* of the inner frame 11 can be engaged with the positioning recesses 12*a* of the housing 12.

Accordingly, the timepiece module 10 can be accurately arranged and positioned inside the inner frame 11, whereby the parting plate 6 can be accurately positioned with respect to the timepiece module 10 via the inner frame 11.

In this case, each of the positioning projections 11*a* of the inner frame 11 is provided in a semi-cylindrical shape and provided on the lower portion of the inner peripheral surface of the inner frame 11 along the vertical direction. Each of the positioning recesses 12*a* of the housing 12 is provided n a semi-cylindrical groove shape and provided on the lower portion of the outer peripheral surface of the housing 12 along the vertical direction.

As a result, the timepiece module 10 can be inserted from above into the inner frame 11, and the positioning projections 11*a* of the inner frame 11 can be fitted into the positioning recesses 12*a* of the housing 12. Accordingly, the timepiece module 10 can be accurately positioned inside the inner frame 11.

That is, regarding the timepiece module 10 and the inner frame 11, since the positioning projections 11*a* of the inner frame 11 are inserted from below and fitted into the positioning recesses 12*a* of the housing 12, the position of the housing 12 in the rotation direction with respect to the inner frame 11 can be accurately restricted.

Additionally, the position of the housing 12 in the vertical direction with respect to the inner frame 11 can also be restricted.

Accordingly, the timepiece module 10 can be accurately positioned inside the inner frame 11, whereby the parting plate 6 can be accurately positioned via the inner frame 11 with respect to the timepiece module 10.

Yet still further, the wristwatch case 1 includes the upper case 2 and the lower case 3, the parting plate 6 is arranged inside the upper case 2, and the inner frame 11 is arranged inside the lower case 3.

Accordingly, the wristwatch case 1 can be easily manufactured, and assembling workability can also be improved.

That is, the wristwatch case 1 can be structured by that the upper case 2 and the lower case 3 are vertically jointed together via the waterproof gasket 4 therebetween.

Thus, the wristwatch case 1 can be easily manufactured even the wristwatch case 1 has a complex shape with the flange-shaped projecting section 14, whereby productivity can be improved.

Additionally, when the parting plate 6 is arranged inside the wristwatch case 1, the parting plate 6 is inserted from above into the upper case 2 and abuts on the flange-shaped projecting section 14 of the upper case 2, whereby the position of the parting plate 6 can be restricted. Accordingly, the assembling work of the parting plate 6 can be easily performed.

Similarly, when the inner frame 11 is arranged inside the wristwatch case 1, the inner frame 11 is inserted into the lower case 3, whereby the upper surface of the inner frame 11 abuts on the flange-shaped projecting section 14 of the upper case 2. As a result, the position of the inner frame 11 can be restricted. Accordingly, the assembling work of the inner frame 11 can be easily performed.

In this case, the flange-shaped projecting section 14 is provided on the lower part on the inner peripheral surface of the upper case 2 in a manner to project toward the inside of the upper case 2. As a result, the thickness of the upper case 2 in the diameter direction can be formed thinner than the thickness of the lower case 3 in the diameter direction.

Still further, the inner diameter of the upper case 2 can be formed larger than the inner diameter of the lower case 3.

As a result, the outer diameter of the parting plate 6 arranged inside the upper case 2 can be formed larger than the inner diameter of the lower case 3. Accordingly, the wristwatch can be made so as to have a wide face.

In the above-described embodiment, the positioning projections 11*a* are provided on the inner peripheral surface of the inner frame 11 and the positioning recesses 12*a* are provided on the outer peripheral surface of the housing 12 of the timepiece module 10. However, the present invention is net limited thereto. For example, positioning recesses may be provided on the inner peripheral surface of the inner frame 11 and the positioning projections may be provided on the outer peripheral surface of the housing 12 of the timepiece module 10.

Also in the above-described embodiment, the wristwatch case 1 is structured of the upper case 2 and the lower case 3. However, the wristwatch case 1 is not necessarily structured of the upper case 2 and the lower case 3. For example, an upper case section and a lower case section may be integrally formed.

Furthermore, in the above-described embodiment, the preset invention is applied to a pointer-type wristwatch. However, the wristwatch is not necessarily a pointer-type wristwatch. For example, the present invention can be applied to various timepieces, such as a travel watch, an alarm clock, a table clock, and a wall clock.

Still further, the present invention is not necessarily applied to a timepiece, and can be widely applied to a portable phone, a portable information terminal and an electronic device where a parting section and a module are required to be positioned.

While the present invention has been described with reference to the preferred embodiments, it is intended that the invention be not limited by any of the details of the description therein but includes all the embodiments which fall within the scope of the appended claims.

What is claimed is:

1. An interior component positioning structure comprising:

a case;

an inner frame which is arranged inside the case and an upper surface of which is provided with a positioning fitting recess;

a module which is arranged as being positioned inside the inner frame; and a parting member which is provided with a parting member positioning projection that is provided on a lower surface of the parting member facing the upper surface of the inner frame, and that is fitted into the positioning fitting recess of the inner frame, thereby positioning the parting member with respect to the inner frame, wherein the case is provided with a flange-shaped projecting section provided on an inner peripheral surface of the case at a position higher than an upper surface of the module and arranged between the inner frame and the parting member, and the flange-shaped projecting section is provided with an insertion hole through which the parting member positioning projection of the parting member is inserted to project, wherein the parting member includes (i) an outer section comprising a first slanted section which is positioned on an upper surface of the flange-shaped projecting section, (ii) a middle section which is adjacent to the outer section and comprises a flat section which is positioned on the upper surface of the flange-shaped projecting section in an area corresponding to the inner frame, (iii) an inner section which is adjacent to the middle section and comprises and a second slanted section which is tilted from an inner peripheral end of the flat section toward the upper surface of the module and projects radially inwardly beyond an inner peripheral end of the flange-shaped projecting section.

2. The interior component positioning structure according to claim 1, wherein either one of an inner peripheral surface of the inner frame or an outer peripheral surface of the module is provided with a positioning projection, and either one of the inner peripheral surface of the inner frame or the outer peripheral surface of the module is provided with a positioning recess with which the positioning projection is engaged.

3. The interior component positioning structure according to claim 1, wherein the case includes an upper case provided with the flange-shaped projecting section, and a lower case, the parting member is arranged inside the upper case, and the inner frame is arranged inside the lower case.

4. The interior component positioning structure according to claim 3, wherein the upper case is formed such that a thickness of the upper case in a diameter direction is thinner than a thickness of the lower case in a diameter direction and that an inner diameter of the upper case is larger than an inner diameter of the lower case.

5. The interior component positioning structure according to claim 1, wherein the case includes an upper case and a lower case, wherein an inner diameter of the upper case is larger than the inner diameter of the lower case, and wherein the upper case and the lower case are joined by a waterproof gasket arranged therebetween.

6. The interior component positioning structure according to claim 1, wherein the case includes an upper case and a lower case, wherein the upper case and the lower case are joined by a waterproof gasket arranged therebetween, and wherein the waterproof gasket is arranged between a lower surface positioned at a boundary between the upper case and the flange-shaped projecting section, and an upper surface of the lower case.

7. The interior component positioning structure according to claim 1, wherein the case includes an upper case and a lower case, wherein an inner diameter of the upper case is larger than the inner diameter of the lower case, wherein the upper case and the lower case are joined by a waterproof gasket therebetween, and wherein the waterproof gasket is arranged between a lower surface positioned at a boundary between the upper case and the flange-shaped projecting section, and an upper surface of the lower case.

8. A timepiece comprising:

a positioning structure, the positioning structure including:

a case, an inner frame which is arranged inside the case and an upper surface of which is provided with a positioning fitting recess, a module which is arranged as being positioned inside the inner frame, and a parting member which is provided with a parting member positioning projection that is provided on a lower surface of the parting member facing the upper surface of the inner frame, and that is fitted into the positioning fitting recess of the inner frame thereby positioning the parting member with respect to the inner frame, wherein the case is provided with a flange-shaped projecting section provided on an inner peripheral surface of the case at a position higher than an upper surface of the module and arranged between the inner frame and the parting member, and the flange-shaped projecting section is provided with an insertion hole through which the parting member positioning projection of the parting member is inserted to project, and wherein the parting member includes (i) an outer section comprising a first slanted section which is positioned on an upper surface of the flange-shaped projecting section, (ii) a middle section which is adjacent to the outer section and comprises a flat section which is positioned on the upper surface of the flange-shaped projecting section in an area corresponding to the inner frame, and (iii) an inner section which is adjacent to the middle section and comprises a second slanted section which is slanted from an inner peripheral end of the flat section toward the upper surface of the module and projects radially inwardly beyond an inner peripheral end of the flange-shaped projecting section.

9. An interior component positioning method comprising:

positioning an inner frame and a module arranged inside a case; and a fitting step of causing a parting member positioning projection provided on a lower surface of a parting member to penetrate through an insertion hole of a flange-shaped projecting section provided on an inner peripheral surface of the case at a position higher than an upper surface of the module and arranged between the inner frame and the parting member, and to be fitted into a positioning fitting recess provided on an upper surface of the inner frame, wherein the parting member includes (i) an outer section comprising a first slanted section, (ii) a middle section which is adjacent to the outer section and comprises a flat section, and (iii) an inner section which is adjacent to the middle section and comprises a second slanted section, and wherein the parting member is positioned in the fitting step such that a first slanted section is positioned on an outer peripheral side of an upper surface of the flange-shaped projecting section, a flat section is positioned on an inner peripheral side of the upper surface of the flange-shaped projecting section in an area corresponding to the inner frame, and the second slanted section is slanted from an inner peripheral end of the flat section toward the upper surface of the module and projects radially inwardly beyond an inner peripheral end of the flange-shaped projecting section.

* * * * *

UNITED STATES PATENT AND TRADEMARK OFFICE

CERTIFICATE OF CORRECTION

PATENT NO. : 9,170,565 B2
APPLICATION NO. : 14/080744
DATED : October 27, 2015
INVENTOR(S) : Kazuma Kobayashi et al.

It is certified that error appears in the above-identified patent and that said Letters Patent is hereby corrected as shown below:

In the Claims:

Column 10, claim 1, line 29, change “tilted” to --slanted--.

Column 12, claim 9, line 29, change “that a” to --that the--.

Column 12, claim 9, line 31, change “a flat” to --the flat--.

Signed and Sealed this
Fifth Day of July, 2016

Michelle K. Lee

Michelle K. Lee
*Director of the United States Patent and Trademark Office*